US010168011B2

(12) United States Patent
Zhang

(10) Patent No.: US 10,168,011 B2
(45) Date of Patent: Jan. 1, 2019

(54) ULTRATHIN LAMP

(71) Applicant: Zhongshan POSO Lighting Co., Ltd., Zhongshan, Guangdong Province (CN)

(72) Inventor: Xichun Zhang, Zhongshan (CN)

(73) Assignee: Zhongshan POSO Lighting Co., Ltd., Zhongshan (CN)

( * ) Notice: Subject to any disclaimer, the term of this patent is extended or adjusted under 35 U.S.C. 154(b) by 0 days.

(21) Appl. No.: 15/585,875

(22) Filed: May 3, 2017

(65) Prior Publication Data

US 2018/0252375 A1 Sep. 6, 2018

(30) Foreign Application Priority Data

Mar. 6, 2017 (CN) ..... 2017 2 0212700 U

(51) Int. Cl.
*F21V 3/02* (2006.01)
*F21S 8/02* (2006.01)
*F21V 5/04* (2006.01)

(52) U.S. Cl.
CPC ..... *F21S 8/026* (2013.01); *F21V 3/02* (2013.01); *F21V 5/04* (2013.01)

(58) Field of Classification Search
CPC ..... F21S 8/026; F21V 3/02; F21V 5/04
See application file for complete search history.

(56) References Cited

U.S. PATENT DOCUMENTS 9,851,490 B2 * 12/2017 Boomgaarden ..... G02B 6/0041
2013/0003369 A1 * 1/2013 Hiraoka ..... F21V 5/007 362/231
2013/0021823 A1 * 1/2013 Yamagami ..... F21S 8/06 362/613
2014/0301076 A1 * 10/2014 Ter-Hovhannisyan ..... F21V 17/16 362/235
2016/0348860 A1 * 12/2016 Bailey ..... F21S 8/024
2016/0363297 A1 * 12/2016 Boulanger ..... F21V 17/005
2017/0082262 A1 * 3/2017 Jung ..... F21V 5/04
2017/0139108 A1 * 5/2017 Boomgaarden ..... G02B 6/0041
2017/0159925 A1 * 6/2017 Boomgaarden ..... F21V 29/71
2017/0307202 A1 * 10/2017 Maxik ..... F21K 9/235
2018/0003373 A1 * 1/2018 Stolte ..... F21V 3/0625
2018/0035510 A1 * 2/2018 Doheny ..... F21V 17/12

* cited by examiner

*Primary Examiner* — Donald L Raleigh
(74) *Attorney, Agent, or Firm* — Fish & Richardson P.C.

(57) ABSTRACT

The present application is applied to lamp field, and a ultrathin lamp is provided, which is configured such that a support table is provided on a mounting base and ratio of the width of the support table to the thickness of the thickest portion of the support table is set to 5.5 to 10, such that under the conditions of satisfying technological feasibility of the support base, the whole thickness of the support table and the lamp can be relatively thin, so that the overall appearance is more decorative and thus satisfying the ultrathin requirements on the market.

14 Claims, 2 Drawing Sheets

ULTRATHIN LAMP

FIELD OF THE INVENTION

The present application relates to the field of lamps, especially to an ultrathin lamp.

BACKGROUND OF THE INVENTION

Current ceiling lamps are mounted to ceilings or walls, which not only are for lighting but also play an important role in decoration to indoor environment on the other hand, therefore, appearance requirement for the ceiling lamps is very high on the market; however, because of unreasonable design of the lamps of the prior art, decorative effect of the lamps have been greatly reduced, which cannot meet ultrathin and ultralight requirement demanded by the market. Therefore, it is necessary to provide an ultrathin lamp.

SUMMARY OF THE INVENTION

The purpose of the present application is to provide an ultrathin lamp and aims to overcome the problem that the lamps of the prior art are too thick which makes the appearance of the lamp lack of aesthetics.

The present application are realized as follows: an ultrathin lamp, which includes a mounting base, a light source plate embedded at the bottom of the mounting base, a lens provided below the light source plate and a diffusion cover provided below the lens; the bottom of the mounting base has a recess in which the light source plate, the lens and the diffusion cover are embedded; a support table including a bottom plate and a curved portion projecting on the bottom plate is provided around the recess; the ratio of the width of the support table to the thickness of the thickest portion of the support table is 5.5 to 10.

Furthermore, the ratio of the width of the support table to the thickness of the thickest portion of the curved portion is 4 to 10.

Specifically, the curved portion includes a base portion having a circular fillet and an arc portion extending over the base portion.

Specifically, the ratio of the width of the support table to the sum of the thickness of the bottom plate and the base portion of the support table is 3.5 to 10.

Furthermore, the ratio of the thickness of the support table to the sum of the thickness of the bottom plate and the base portion of the support table is 1 to 3.

Furthermore, curvature of the arc portion of the curved portion is different from curvature of the diffusion cover.

Furthermore, the support table is of circular or regular polygonal.

Furthermore, the diffusion cover is of circular or regular polygonal.

Furthermore, the recess at the bottom of the mounting base includes a first recess recessed at the bottom of the mounting base and a second recess recessed in the first recess; the light source plate and the lens are embedded in the second recess and the diffusion cover is embedded in the first recess.

The ultrathin lamp provided by the present application is configured such that the support table is provided on the mounting base and the ratio of the width of the support table to the thickness of the thickest portion of the support table is set to 5.5 to 10, such that under the conditions of satisfying technological feasibility of the support base, the whole thickness of the support table and the lamp can be relatively thin, so that the overall appearance is more decorative and thus satisfying the ultrathin requirements on the market.

DETAILED DESCRIPTION OF THE PREFERRED EMBODIMENT

In order to make the purposes, technical solutions, and advantages of the present application clearer, the present application will be further described in detail hereinafter with reference to accompanying drawings and embodiments. It should be understood that the specific embodiments described herein are merely intended to explain but not to limit the present application.

It is to be noted that when referred to as being "fixed to" or "arranged in" another element, an element may be located directly on the another element, or a third element exists therebetween. When referred to as being "connected to" another element, an element may be directly connected to the another element, or a third element exists therebetween.

It is also to be noted that locality terms such as left, right, upper and lower in the embodiment are relative concepts, or referenced against normal operation state of a product, which should not be deemed limitative.

Figure 1:
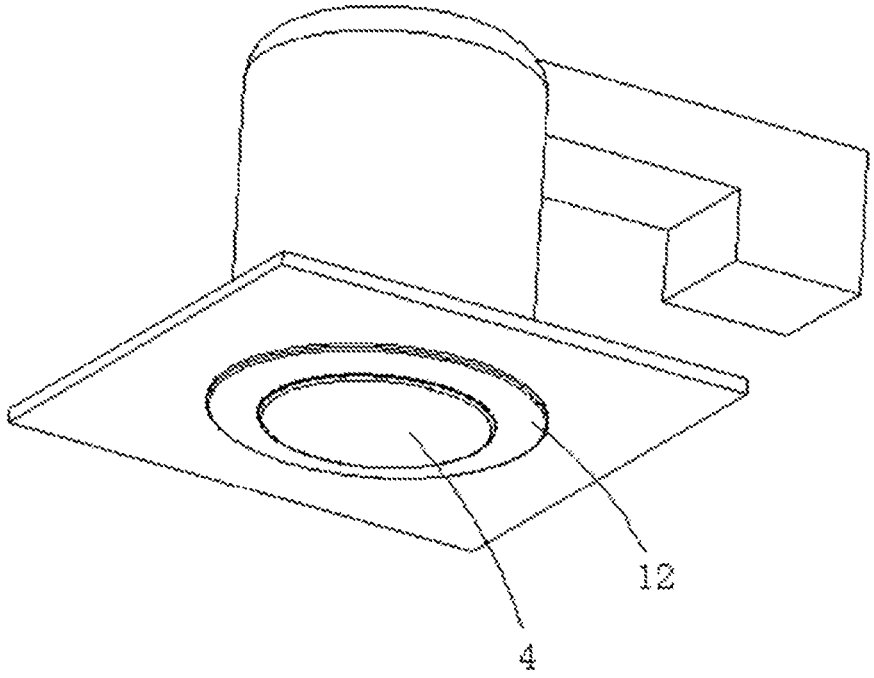
FIG. 1 a perspective schematic view of an ultrathin lamp provided by an embodiment of the present application.
Figure 2:
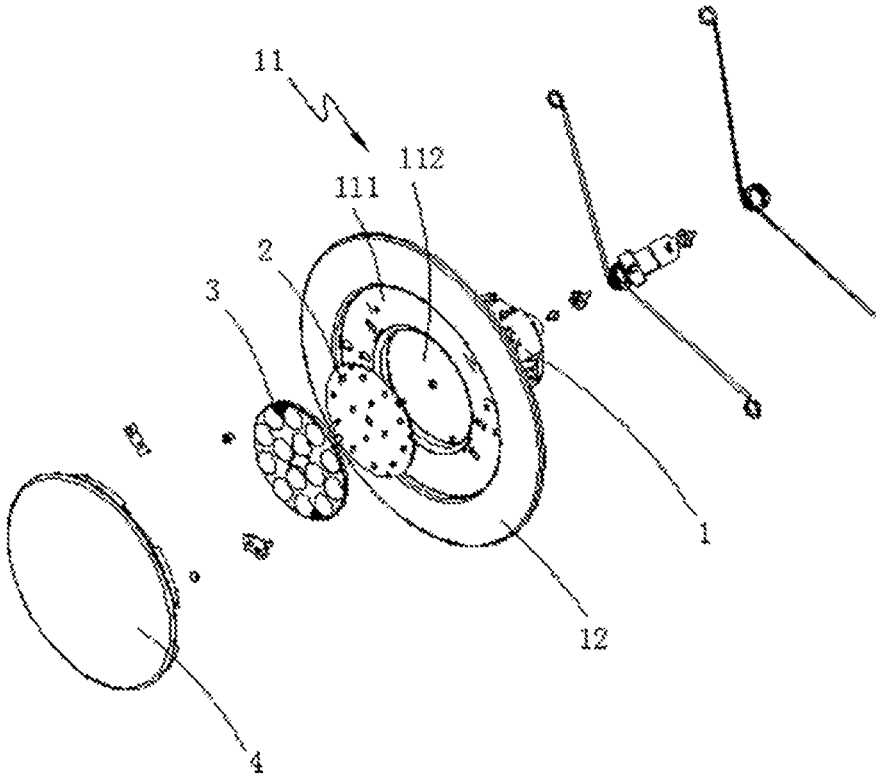
FIG. 2 is a local exploded schematic view of an ultrathin lamp provided by an embodiment of the present application.
Figure 3:
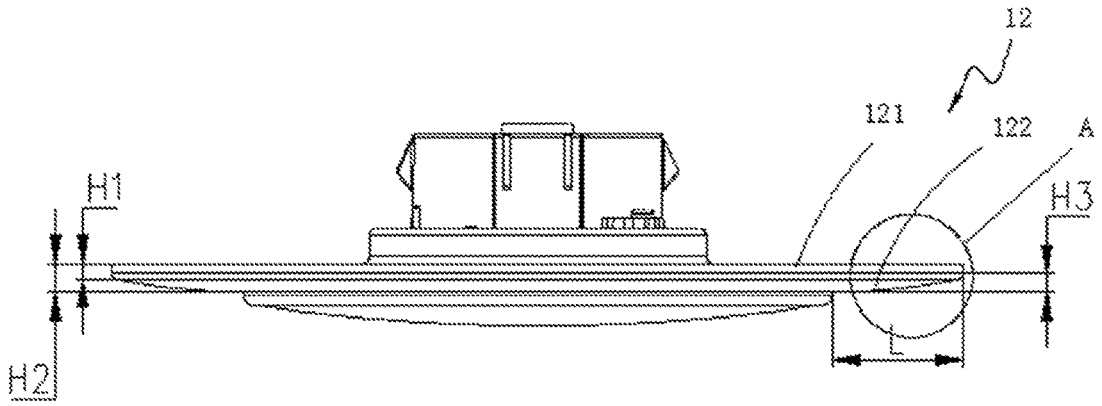
FIG. 3 is a side schematic view of an ultrathin lamp provided by an embodiment of the present application.
Figure 4:
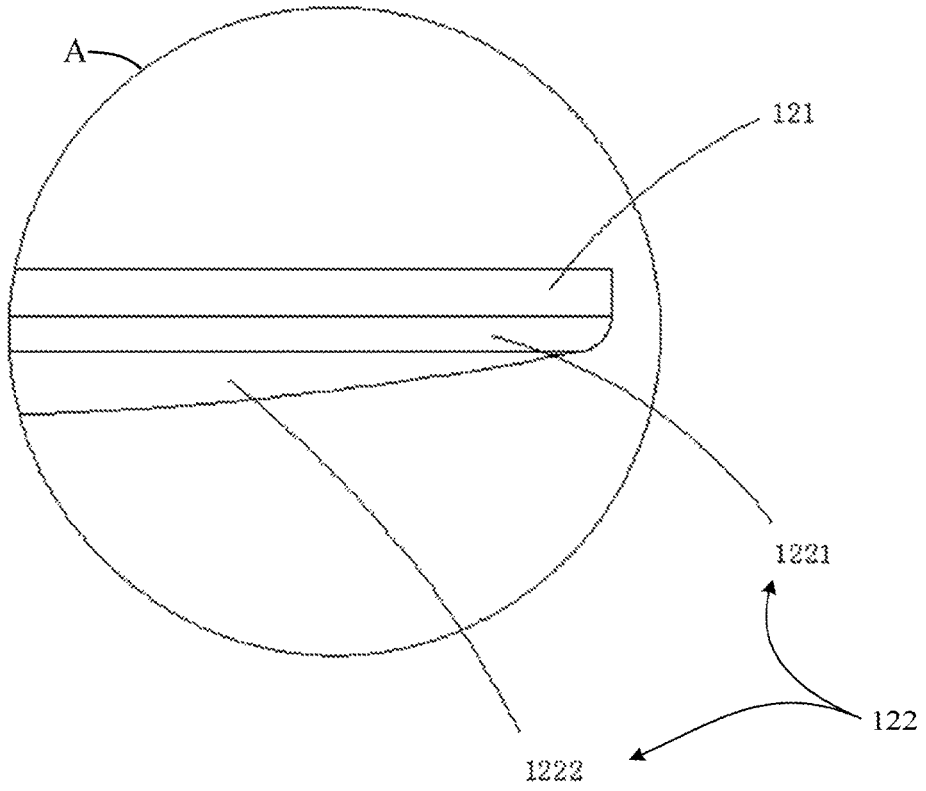
FIG. 4 is an enlarged schematic view of portion A in FIG. 3.

FIGS. 1 to 4 are respective schematic views of an ultrathin lamp provided by an embodiment of the present application; the ultrathin lamp includes a mounting base 1, a light source plate 2 embedded at the bottom of the mounting base 1, a lens 3 provided below the light source plate 2 and a diffusion cover 4 provided below the lens 3. Furthermore, the bottom of the mounting base 1 has a recess 11 in which the light source plate 2, the lens 3 and the diffusion cover 4 are embedded; a support table 12 including a bottom plate 121 and a curved portion 122 projecting on the bottom plate 121 is provided around the recess 11. The ratio of the width L of the support table 12 to the thickness H2 of the thickest portion of the support table 12 is 5.5 to 10. Therefore, overall thickness of the lamp is relatively thin, and thus meets the lighting requirement, at the same time, can fully meet the need for decoration on the market.

The ultrathin lamp provided by the present application is configured such that the support table 12 is provided on the mounting base 1 and the ratio of the width L of the support table 12 to the thickness H2 of the thickest portion of the support table 12 is set to 5.5 to 10, such that under the conditions of satisfying technological feasibility of the support base 12, the whole thickness of the support table 12 and the is lamp can be relatively thin, so that the overall appearance is more decorative and thus satisfying the ultrathin requirements on the market.

Preferably, the support table 12 may be made of plastic material or metallic material, and when the support table 12 is made of plastic material, the appearance of the support table 12 is beautiful, and since the plastic has a certain malleability, the situation which the support table 12 is under force and easy to has an irregular external surface which makes the appearance not good can be avoided; when the support table 12 is made of metal material, heat dissipation of the support table 12 is better, which can help extend service life of the lamp.

As a specific embodiment, the ratio of the width L of the support table 12 to the thickness H3 of the thickest portion of the curved portion 122 is 4 to 10, and the thickest portion of the curved portion 122 is an inner contour line of the support table 12, which means the ratio of the width L of the support table 12 to the thickness of the inner contour line of the support table 12 is 4 to 10, therefore, the thickness of the support table 12 can be made thin so that the weight of the whole mounting base 1 is also lighter.

As a specific embodiment, the curved portion 122 includes a base portion 1221 having a circular fillet and an arc portion 1222 extending over the base portion 1221. The base portion 1221 having the circular fillet is provided such that the transition between the bottom plate 121 of the support table 12 and the arc portion 1222 is more smooth and softer, so as to enhance sense of beauty of the appearance.

As a specific embodiment, the ratio of the width L of the support table 12 to the sum of the thickness H1 of the bottom plate 121 and the base portion 1221 of the support table 12 is 3.5 to 10. In this way, the thickness of the support table 12 can be further restricted.

As a preferred embodiment, the ratio of the thickness H2 of the support table 12 to the sum of the thickness H1 of the bottom plate 121 and the base portion 1221 of the support table 12 is 1 to 3. In this way, the thickness of the support table 12 can be further controlled within a thinner range so as to meet the market requirements.

As a specific embodiment, the curvature of the arc portion 1222 of the curved portion 122 is different from the curvature of the diffusion cover 4, so that the support table 12 and the diffusion cover 4 can be independent of each other and the overall thickness of the support table 12 can be made thinner; the diffusion cover 4 can be further set according to requirements for light diffusion, so as to meet design requirements.

As a specific embodiment, the support table 12 may be of circular or regular polygonal, for example, a regular quadrilateral, a regular hexagon, etc., and may be appropriately adjusted according to the customer's needs, which should not be limited herein.

As a specific embodiment, the diffusion cover 4 may also be of circular or regular polygonal. Preferably, the shape of the support table 12 is identical with the shape of the diffusion cover 4.

As a specific embodiment, the recess 11 at the bottom of the mounting base 1 includes a first recess 111 recessed at the bottom of the mounting base 1 and a second recess 112 recessed in the first recess 111, which means the recess 11 at the bottom of the mounting base 1 is a stepped recess in which both the light source plate 2 and the lens 3 are embedded in the second recess 112 and the diffusion cover 4 is embedded in the first recess 111. In this way, not only the overall thickness of the mounting base 1 and the support table 12 can be made relatively thin, but also the light diffusion effect of the diffusion cover 4 can be satisfied.

The above contents are only preferred embodiments of the present application, and are not intended to limit the present application. Any modifications, equivalent replacements and improvement made within the spirit and principle of the present application should be contained within the protection scope of the present application.

What is claimed is:

1. An ultrathin lamp, comprising a mounting base, a light source plate embedded at the bottom of the mounting base, a lens provided below the light source plate and a diffusion cover provided below the lens;

wherein the bottom of the mounting base has a recess in which the light source plate, the lens and the diffusion cover are embedded; a support table including a bottom plate and a curved portion projecting on the bottom plate is provided around the recess; ratio of width of the support table to thickness of the thickest portion of the support table is 5.5 to 10; the curved portion includes a base portion having a circular fillet and an arc portion extending over the base portion; and the ratio of the thickness of the support table to the sum of the thickness of the bottom plate and the base portion of the support table is 1 to 3.

2. The ultrathin lamp of claim 1, wherein the ratio of the width of the support table to the thickness of the thickest portion of the curved portion is 4 to 10.

3. The ultrathin lamp of claim 1, wherein the ratio of the width of the support table to sum of the thickness of the bottom plate and the base portion of the support table is 3.5 to 10.

4. The ultrathin lamp of claim 1, wherein curvature of the arc portion of the curved portion is different from curvature of the diffusion cover.

5. The ultrathin lamp of claim 1, wherein the support table is circular or a regular polygon.

6. The ultrathin lamp of claim 1, wherein the diffusion cover is circular or a regular polygon.

7. The ultrathin lamp of claim 1, wherein the recess at the bottom of the mounting base includes a first recess recessed at the bottom of the mounting base and a second recess recessed in the first recess; the light source plate and the lens are embedded in the second recess and the diffusion cover is embedded in the first recess.

8. The ultrathin lamp of claim 2, wherein the recess at the bottom of the mounting base includes a first recess recessed at the bottom of the mounting base and a second recess recessed in the first recess; the light source plate and the lens are embedded in the second recess and the diffusion cover is embedded in the first recess.

9. The ultrathin lamp of claim 1, wherein the recess at the bottom of the mounting base includes a first recess recessed at the bottom of the mounting base and a second recess recessed in the first recess; the light source plate and the lens are embedded in the second recess and the diffusion cover is embedded in the first recess.

10. The ultrathin lamp of claim 3, wherein the recess at the bottom of the mounting base includes a first recess recessed at the bottom of the mounting base and a second recess recessed in the first recess; the light source plate and the lens are embedded in the second recess and the diffusion cover is embedded in the first recess.

11. The ultrathin lamp of claim 1, wherein the recess at the bottom of the mounting base includes a first recess recessed at the bottom of the mounting base and a second recess recessed in the first recess; the light source plate and the lens are embedded in the second recess and the diffusion cover is embedded in the first recess.

12. The ultrathin lamp of claim 4, wherein the recess at the bottom of the mounting base includes a first recess recessed at the bottom of the mounting base and a second recess recessed in the first recess; the light source plate and the lens are embedded in the second recess and the diffusion cover is embedded in the first recess.

13. The ultrathin lamp of claim 5, wherein the recess at the bottom of the mounting base includes a first recess recessed at the bottom of the mounting base and a second recess recessed in the first recess; the light source plate and the lens are embedded in the second recess and the diffusion cover is embedded in the first recess.

14. The ultrathin lamp of claim 6, wherein the recess at the bottom of the mounting base includes a first recess recessed at the bottom of the mounting base and a second recess recessed in the first recess; the light source plate and the lens are embedded in the second recess and the diffusion cover is embedded in the first recess.

* * * * *